US011509074B2

(12) United States Patent
Jarmuth et al.

(10) Patent No.: US 11,509,074 B2
(45) Date of Patent: Nov. 22, 2022

(54) SPRING-FORCE TERMINAL CONNECTION AND CONDUCTOR CONNECTION TERMINAL

(71) Applicant: Phoenix Contact GmbH & Co. KG, Blomberg (DE)

(72) Inventors: Volker Jarmuth, Horn-Bad Meinberg (DE); Peter Klimala, Paderborn (DE)

(73) Assignee: Phoenix Contact GmbH & Co. KG, Blomgberg (DE)

( * ) Notice: Subject to any disclaimer, the term of this patent is extended or adjusted under 35 U.S.C. 154(b) by 0 days.

(21) Appl. No.: 17/047,071

(22) PCT Filed: Mar. 22, 2019

(86) PCT No.: PCT/EP2019/057228
§ 371 (c)(1),
(2) Date: Oct. 13, 2020

(87) PCT Pub. No.: WO2019/201550
PCT Pub. Date: Oct. 24, 2019

(65) Prior Publication Data

US 2021/0167526 A1 Jun. 3, 2021

(30) Foreign Application Priority Data

Apr. 20, 2018 (DE) ..... 10 2018 109 545.7

(51) Int. Cl.
*H01R 4/48* (2006.01)

(52) U.S. Cl.
CPC ..... *H01R 4/4836* (2013.01); *H01R 4/4809* (2013.01)

(58) Field of Classification Search
CPC ..... H01R 4/4836; H01R 4/48; H01R 4/4809; H01R 4/4818; H01R 4/4827
See application file for complete search history.

(56) References Cited

U.S. PATENT DOCUMENTS 4,582,380 A 4/1986 Wider et al.
5,975,940 A 11/1999 Hartmann et al.
(Continued)

FOREIGN PATENT DOCUMENTS

DE 1975762 U 12/1967
DE 6916530 U 10/1969
(Continued)

OTHER PUBLICATIONS

Machine translation of DE 102012005465 B3 (Year: NA).*

*Primary Examiner* — Oscar C Jimenez
*Assistant Examiner* — Paul D Baillargeon
(74) *Attorney, Agent, or Firm* — Leydig, Voit & Mayer, Ltd.

(57) ABSTRACT

A spring-force terminal connection for connecting a conductor includes: a bus bar; a clamping spring by which the conductor to be connected is clamped against the bus bar when in a clamped state; a pivotably arranged actuation lever, the clamping spring being actuatable by a pivoting movement of the actuation lever; and a clamping cage, which forms a space for accommodating the conductor to be connected. The clamping spring includes a leaf spring and has a first end section forming a clamping region and a second end section opposite the first end section and forming a holding region. The clamping spring is fastened to the clamping cage by the second end section.

10 Claims, 3 Drawing Sheets

(56) References Cited

U.S. PATENT DOCUMENTS

| | | | | |
|---|---|---|---|---|
| 6,146,187 | A | 11/2000 | Pallai | |
| 6,261,120 | B1 | 7/2001 | Beege et al. | |
| 8,251,738 | B2 * | 8/2012 | Heckert ..... | H01R 4/4836 439/441 |
| 9,276,331 | B2 | 3/2016 | Stadler et al. | |
| 10,193,244 | B2 | 1/2019 | Aboulkassem et al. | |
| 10,297,931 | B2 | 5/2019 | Koellmann et al. | |
| 2013/0095697 | A1 | 4/2013 | Wu et al. | |
| 2016/0049737 | A1 | 2/2016 | Aporius et al. | |

FOREIGN PATENT DOCUMENTS

| | | | | |
|---|---|---|---|---|
| DE | 7705459 | U | 6/1977 | |
| DE | 8704494 | U1 | 6/1987 | |
| DE | 19654611 | A1 | 6/1998 | |
| DE | 29915515 | U1 | 2/2001 | |
| DE | 202005005369 | U1 | 3/2006 | |
| DE | 102012019987 | A1 | 4/2013 | |
| DE | 102012005465 | B3 | 5/2013 | |
| DE | 202013101582 | U1 | 7/2014 | |
| DE | 102014200271 | A1 | 7/2015 | |
| DE | 202015102045 | U1 | 7/2016 | |
| DE | 102015115791 | A1 | 3/2017 | |
| DE | 102015118033 | A1 | 4/2017 | |
| EP | 1622224 | A1 | 2/2006 | |
| EP | 2894718 | A2 | 7/2015 | |
| EP | 2947718 | A1 | 11/2015 | |
| EP | 3116065 | A1 * | 1/2017 | ..... H01R 4/4836 |
| EP | 3159971 | A1 | 4/2017 | |
| JP | 3078590 | U | 7/2001 | |
| JP | 2017022100 | A | 1/2017 | |

* cited by examiner

SPRING-FORCE TERMINAL CONNECTION AND CONDUCTOR CONNECTION TERMINAL

CROSS-REFERENCE TO PRIOR APPLICATIONS

This application is a U.S. National Phase application under 35 U.S.C. § 371 of International Application No. PCT/EP2019/057228, filed on Mar. 22, 2019, and claims benefit to German Patent Application No. DE 10 2018 109 545.7, filed on Apr. 20, 2018. The International Application was published in German on Oct. 24, 2019 as WO/2019/201550 under PCT Article 21(2).

FIELD

The invention relates to a spring-force terminal connection for connecting a conductor, having a bus bar, a clamping spring by means of which the conductor to be connected is clamped against the bus bar when in the clamped state, and a pivotably arranged actuation lever, wherein the clamping spring can be actuated by means of a pivoting movement of the actuation lever. The invention further relates to a conductor terminal having a corresponding spring-force terminal connection.

BACKGROUND

Conductor terminals are known in a multitude of variants. Usually, a clamping spring designed as a leg spring, which has a support leg and a clamping leg, is used for the spring-force terminal connection, which clamping spring can clamp a conductor to be connected with its clamping leg against the bus bar. In order to be able to achieve a tilt-proof position of the clamping spring, the latter usually bears with its support leg flat against an insulating material housing of the conductor terminal. However, such embodiment requires a relatively large installation space of the spring-force terminal connection and thus also of the conductor terminal.

SUMMARY

In an embodiment, the present invention provides a spring-force terminal connection for connecting a conductor, comprising: a bus bar; a clamping spring by which the conductor to be connected is clamped against the bus bar when in a clamped state; a pivotably arranged actuation lever, the clamping spring being actuatable by a pivoting movement of the actuation lever; and a clamping cage, which forms a space configured to accommodate the conductor to be connected, wherein the clamping spring comprises a leaf spring and has a first end section forming a clamping region and a second end section opposite the first end section and forming a holding region, and wherein the clamping spring is fastened to the clamping cage by the second end section.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
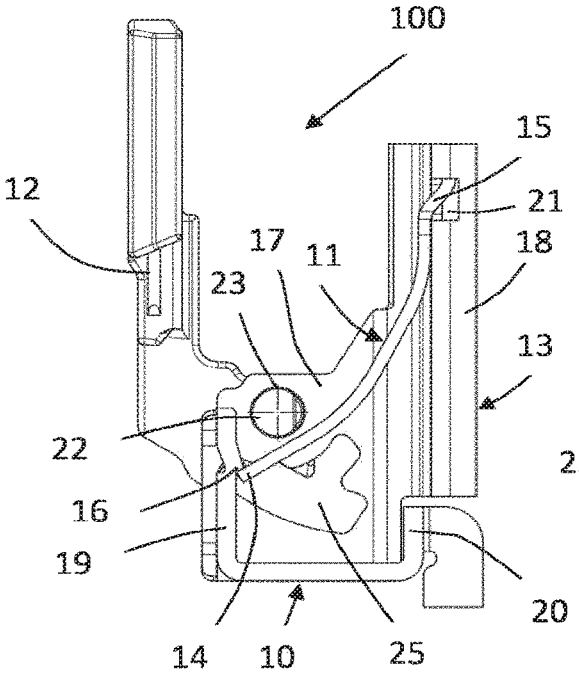
FIG. 1 is a schematic representation of a spring-force terminal connection according to the invention in a front view.

In an embodiment, the present invention provides a spring-force terminal connection and a conductor terminal which are characterized by a reduced installation space.

The spring-force terminal connection according to the invention is characterized in that a clamping cage is provided, which forms a space for accommodating the conductor to be connected, and in that the clamping spring is designed as a leaf spring and has a first end section designed as a clamping region and a second end section opposite the first end section and designed as a holding region, wherein the clamping spring is fastened to the clamping cage with its second end section.

The clamping spring is now no longer designed as a leg spring according to the invention, but rather the clamping spring is designed as a leaf spring. The leaf spring is in the form of a sheet or strip. Since the leaf spring, compared to a leg spring, has only one leg and not two legs, such clamping spring designed as a leaf spring has a smaller overall size than a clamping spring designed as a leg spring. Due to the smaller overall size, it also requires less space in the spring-force terminal connection, so that the entire spring-force terminal connection can be made smaller in size. The clamping spring is not held on an insulating material housing, but is fastened or held on an additionally provided clamping cage. This clamping cage also simultaneously forms a space for accommodating the conductor to be connected. The clamping spring is held on the clamping cage with a second end section which lies opposite a first end section forming a clamping area for clamping the conductor. With the second end section, the clamping spring is thus preferably held in a fixed, defined position, whereas with its first end section the clamping spring is preferably movable, especially pivotable. In order to be able to improve the spring action of the clamping spring and/or to simplify the mounting of the clamping spring on the clamping cage, the clamping spring preferably has a cross-sectional reduction or taper going from its first end section toward its second end section.

For fastening the clamping spring to the clamping cage, an opening can be formed on the clamping cage, in which opening the clamping spring can be hooked with its second end section. For this purpose, the second end section of the clamping spring can preferably be bent in order to be hooked into the opening. The opening is preferably in the form of a window-like opening. By fastening the clamping spring in an opening of the clamping cage, the clamping spring can be mounted on the clamping cage especially easily, so that the assembly effort can be reduced. In addition, the fastening of the clamping spring also does not take up a large amount space in the spring-force terminal connection.

In order also to be able to clamp conductors with a small conductor cross-section, a projection can be formed on the bus bar on which the clamping spring can be held pretensioned with its first end section when in a non-clamped state. As a result of the pretensioning of the clamping spring, the force to be applied to the clamping spring can be reduced when the clamping spring is transferred from the non-clamped state into the clamped state. The projection may be configured in the form of an edge protruding from the surface of the bus bar. The projection can form an undercut on the bus bar, on which the clamping spring can engage with its first end section, which forms the clamping region, in the unclamped state.

The actuation lever can be pivotably mounted on the clamping cage. The overall size of the spring-force terminal connection can be further reduced by mounting on the clamping cage. For example, the actuation lever can have at least one pivot axis about which the actuation lever can be pivoted, wherein it is possible for the actuation lever to engage with its pivot axis in a recess formed on the clamping cage.

On the first end section of the clamping spring, an actuation surface formed laterally on the first end section of the clamping spring can be formed and can interact with the actuation lever for actuating the clamping spring. Due to the laterally formed actuation surface, the clamping spring can be widened at its first end section relative to the second end section. An actuating point of the actuating element on the clamping spring for actuating the clamping spring can be determined in a defined manner via the actuation surface, wherein such actuating point preferably is positioned outside the actual clamping region of the clamping spring for clamping the conductor. However, the lateral formation of the actuation surface on the second end section makes it possible for the clamping spring to be simultaneously actuated by means of the actuating element at the level of the first end section and thus of the clamping region, so that the force expenditure to apply to the clamping spring for actuating the clamping spring can be reduced by means of the actuation lever.

Furthermore, it can be provided that a guide contour in the shape of a window-like opening is formed on the clamping cage through which opening the actuation surface of the clamping spring can protrude, so that the actuation surface of the clamping spring can interact with the actuation lever outside the clamping cage. The guide contour can thus form a targeted guidance of the clamping spring when it is transferred into the clamped and the non-clamped state of the clamping spring. Lateral tilting of the clamping spring can thereby be reliably prevented, because the clamping cage can form a lateral boundary wall for the clamping spring. The guide contour can also determine the pivot travel, especially the length of the pivot travel, of the clamping spring in a defined manner, so that too wide a pivoting of the clamping spring or a too wide a deflection of the clamping spring with its first end section can be prevented.

The clamping cage is preferably made of a metal. Making it out of metal allows the clamping spring to be securely fastened to the clamping cage for a long period of time, because deformation of the clamping cage can be reliably prevented even in the event of a force from the clamping spring acting on the clamping cage, for example by actuating the clamping spring.

The clamping spring is preferably actuated by means of the actuation lever via a circumferential surface of the actuation lever, which can apply a compressive force to the clamping spring or to the first end section of the clamping spring by pivoting of the actuation lever. The actuation lever preferably has an actuating cam for actuating the clamping spring, wherein the actuation lever can be rolled down on the clamping spring with the outer surface of the actuating cam when the actuation lever is pivoted in order to actuate the clamping spring.

An embodiment of the present invention also provides a conductor terminal which has a housing in which a spring-force terminal connection is arranged that is formed and developed as described above. The housing is preferably formed from an insulating material, for example a plastic. Due to the more compact design of the spring-force terminal connection, the housing surrounding the spring-force terminal connection can also be made more compact, as a result of which the entire conductor terminal can be made more compact.

In order to also be able to improve the handling of the conductor terminal for a user, the housing can have a latching region on which the actuation lever can be latched. The latching can provide a defined, fixed position of the actuation lever relative to the housing in a non-actuated state of the actuation lever.

FIG. 1 shows a spring-force terminal connection 100 according to the invention which has a bus bar 10, a clamping spring 11, an actuation lever 12 and a clamping cage 13.

The clamping spring 11 is formed as a leaf spring and has a first end section 14, which forms a clamping region, and a second end section 15, which is opposite the first end section 14 in the longitudinal direction of the clamping spring 11 and forms a holding region. The clamping spring 11 has a sheet-form or strip-form contour. With the first end section 14, a conductor L to be connected is clamped against the bus bar 10 to form an electrical contact.

The bus bar 10 is U-shaped and is positioned in the clamping cage 13 and thus held within the clamping cage 13. A projection 16 is formed on the leg of the bus bar 10 on which the conductor L is clamped and on which the clamping spring 11 with its first end section 14 is held pretensioned in an unclamped state, as can be seen in FIG. 1. The unclamped state is the state, with which no conductor L is connected. The projection is designed in the form of a projecting latching lug which forms an undercut behind which the clamping spring 11 can hook with its first end section 14.

The clamping cage 13 forms a space for accommodating the conductor L to be connected. The clamping cage 13 has at least one first wall 17 and a second wall 18 running transversely to the first wall 17. The first wall 17 extends laterally from the clamping spring 11 and thus along the longitudinal side of the clamping spring 11, so that upon actuation of the clamping spring 11 it is guided along the first wall 17. The first wall 17 extends from a support leg 19 of the bus bar, against which the conductor L to be connected is clamped, to a retaining leg 20 of the bus bar 10 opposite the support leg 19. The projection 16 is also formed on the support leg 19.

The second wall 18 extends transversely to the first wall 17 and thus extends transversely to the longitudinal direction of the clamping spring 11. The second wall 18 has a height which is greater than the first wall 17 and is thus of longer design. The second wall 18 projects beyond the clamping spring 11, especially the second end section 15 of the clamping spring 11.

The clamping spring 11 is detachably fastened at its second end section 15 to the clamping cage 13, in that the clamping spring 11 with its second end section 15 is hooked into the clamping cage 13. For this purpose, a window-like opening 21 is formed on the clamping cage 13, especially on the second wall 18 of the clamping cage 13, in which opening the clamping spring 11 with its second end section 15 is hooked. The second end section 15 is bent for this purpose. The bend of the second end section 15 has a Z-like shape, in that the bend has two oppositely oriented bent sections.

The clamping cage 13 is made of a metal.

For actuating the clamping spring 11, an actuation lever 12 is provided, which is pivotably mounted on the clamping cage 13. The actuation lever 12 has a pivot axis 22 which is rotatably mounted in a recess 23 of the clamping cage 13. The recess 23 is formed on the first wall 17 of the clamping cage 13.

Figure 2:
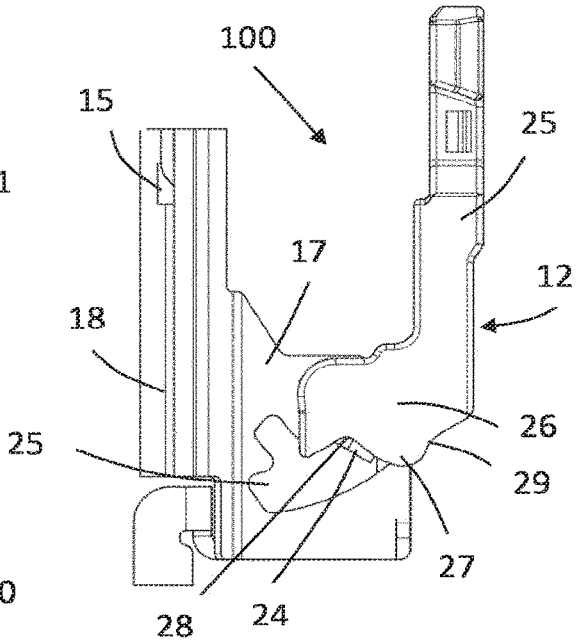
FIG. 2 is a schematic representation of the spring-force terminal connection in FIG. 1 in a rear view.

The clamping spring 11 has an actuation surface 24, as shown in FIG. 2, via which the clamping spring 11 cooperates with the actuation lever 12 by the actuation lever 12 pressing on this actuation surface 24 and thereby being able to transfer the clamping spring 11 into the clamped state and the unclamped state. The actuation surface 24 is formed laterally on the first end section 14 of the clamping spring 11, so that the clamping spring 11 has a widened surface here.

A guide contour in the form of a window-like opening 25 is formed on the clamping cage 13, through which opening the actuation surface 24 of the clamping spring 11 protrudes, so that the actuation surface 24 of the clamping spring 11 cooperates with the actuation lever 12 outside the clamping cage 13 and thus also outside the space for accommodating the conductor L. The window-like opening 25 is formed on the first wall 17 of the clamping cage 13. The window-like opening 25 extends over almost the entire width of the first wall 17.

The actuation lever 12 has a grip area 25 for manually actuating the actuation lever 12 and an actuating region 26 which interacts with the clamping spring 11. The actuation region 26 may be formed integrally with the grip area. The actuation lever 12 is pivotably mounted on the clamping cage 13 with its actuating region 26. An actuating cam 27 for actuating the clamping spring 11 is formed on the actuating region 26. The actuating cam 27 gives the actuating region 26 a wavelike contour at this point on its circumferential outer surface. When the clamping spring 11 is actuated, the actuation lever 12 rolls with the actuating cam 27 on the clamping spring 11, especially on the actuation surface 24 of the clamping spring 11. An indentation 28, 29 is formed both in front of and behind the actuating cam 27, wherein in an unopened state of the clamping spring 11, i.e. when the clamping spring 11 rests against the bus bar 10, the clamping spring 11 hooks behind a first indentation 28 with the actuation surface 24, as can be seen in FIG. 2, and in an opened state of the clamping spring 11, i.e. if the clamping spring 11 is spaced apart from the bus bar 10, so that a conductor L can be inserted into the accommodating space, the clamping spring 11 is hooked behind a second indentation 29 with the actuation surface 24, as can be seen in FIG. 4.

The actuation lever 12 is pivotable by an angle of 90°.

Figure 3:
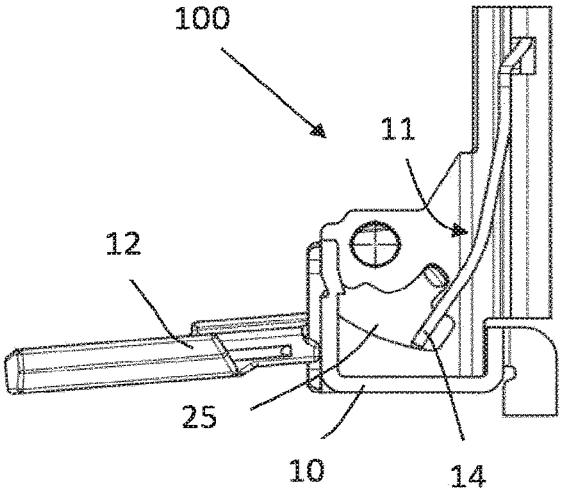
FIG. 3 is a further schematic representation of the spring-force terminal connection shown in FIG. 1 in a front view.
Figure 4:
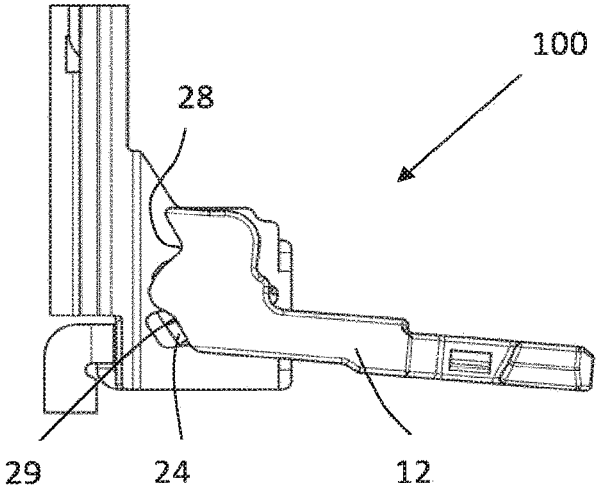
FIG. 4 is a further schematic representation of the spring-force terminal connection shown in FIG. 1 in a rear view.

FIGS. 3 and 4 show a position, with which the actuation lever 12 is pivoted downward, wherein during the pivoting movement the first end section 14 of the clamping spring 11 has been pivoted over the actuation surface 24 of the clamping spring 14, so that the first end section 14 is held by means of the actuation lever 12 in a position spaced apart from the bus bar 10. In this position, a conductor L to be connected can be inserted into the accommodating space and thus into the intermediate space between the bus bar 10 and the clamping spring 11.

Figure 5:
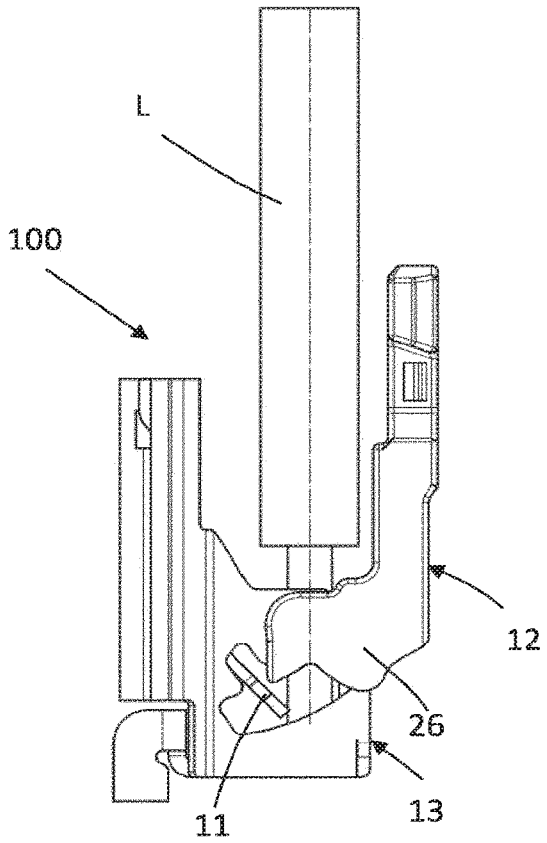
FIG. 5 is a schematic representation of a rear view of a spring-force terminal connection as shown in FIG. 1 with a connected conductor.
Figure 6:
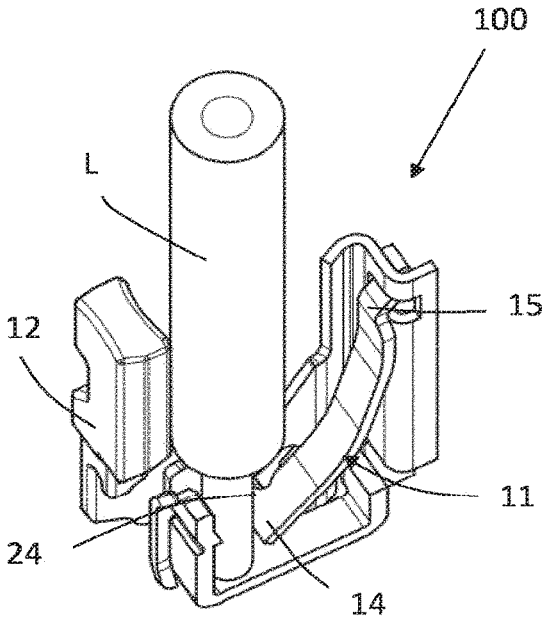
FIG. 6 is a schematic representation of a perspective view of a spring-force terminal connection as shown in FIG. 1 with a connected conductor.

If the conductor L to be connected is inserted into the accommodating space, the actuation lever 12 can be pivoted back upward, so that the actuation lever 12 is positioned with its grip area 27 parallel to the second wall 18 of the clamping cage 13, as shown in FIGS. 5 and 6.

If a conductor L is connected, the actuation lever 12 has no contact with the clamping spring 11 or with the actuation surface 24 of the clamping spring 11, at least in the case of certain conductor cross-sections, as can be seen in FIGS. 5 and 6. The actuation lever 12 in this state is thus disengaged from the clamping spring 11.

FIG. 6 also shows that the cross-section of the clamping spring 11 tapers from the first end section 14 toward the second end section 15.

Figure 7:
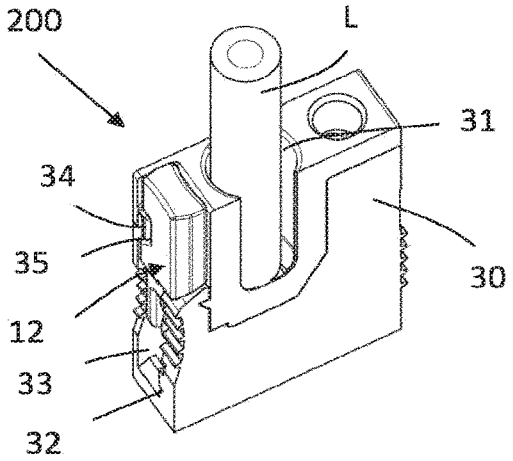
FIG. 7 is a schematic representation of a conductor terminal according to the invention having a connected conductor.
Figure 8:
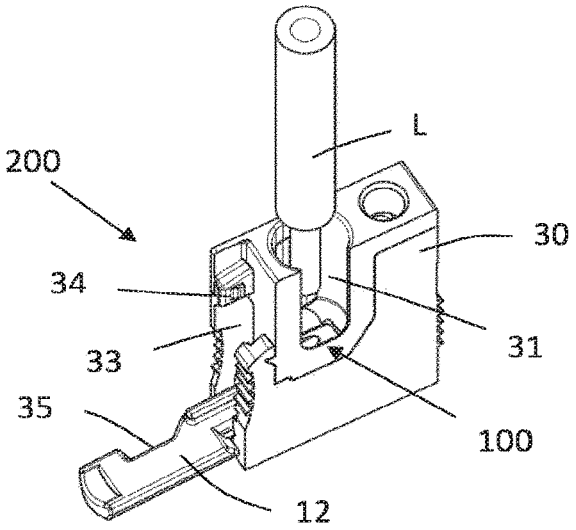
FIG. 8 is a further schematic representation of the conductor terminal shown in FIG. 7.

FIG. 7 shows a conductor terminal 200 having a corresponding spring-force terminal connection 100, which is arranged in a housing 30, especially an insulating material housing. The housing 30 has a conductor insertion opening 31 for inserting the conductor L. A clearance 33 is formed on a transverse side 32 of the housing 30, in which the actuation lever 12 is movably arranged, as can be seen in FIGS. 7 and 8. In the area of the clearance 33, the housing 30 has a latching region 34 at which the actuation lever 12 can be latched. The latching region 34 is designed here in the form of a latching lug. A recess 35 is formed on the actuation lever 12 with which the actuation lever 12 can hook on the latching lug.

Figure 9:
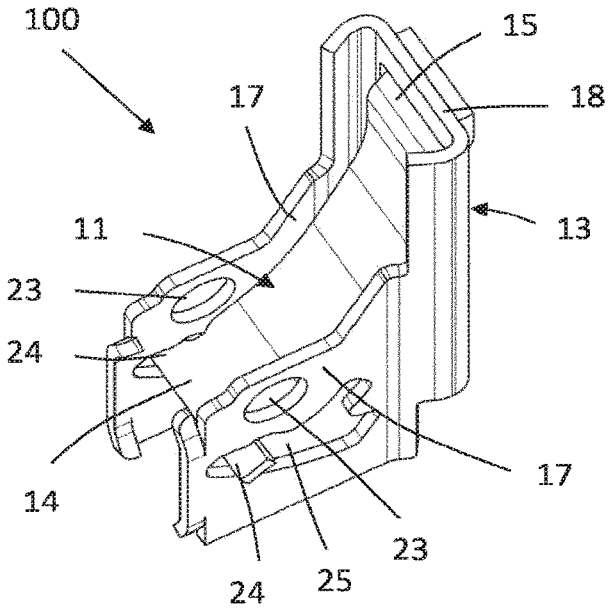
FIG. 9 is a schematic representation of a further design variant of the spring-force terminal connection according to the invention.
Figure 10:
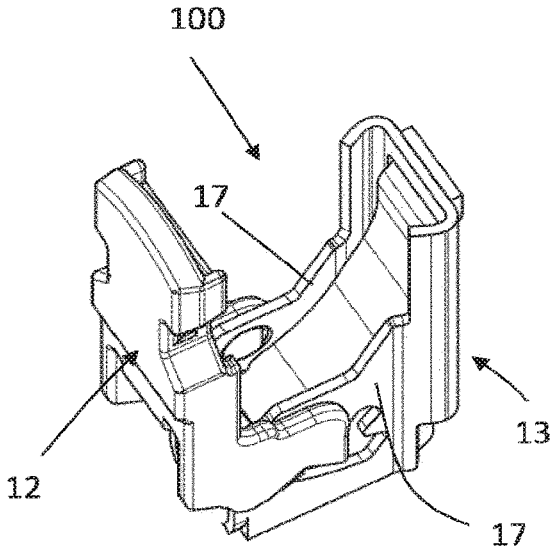
FIG. 10 is a further schematic representation of the spring-force terminal connection shown in FIG. 9.

FIGS. 9 and 10 show a further embodiment variant of a spring-force terminal connection 100, with which the clamping cage 13 has two opposing first walls 17, each of which has a recess 23, in which the actuation lever 12 is pivotably mounted, as can be seen in FIG. 10. For this purpose, the actuation lever 12 also has two opposite pivot axes 22, which are each rotatably mounted in one of the two recesses 23. Furthermore, a window-like opening 25 for forming a guide contour is formed on each of the first walls 17, wherein the clamping spring 11 has two opposing actuation surfaces 24, each of which protrudes through one of the two openings 25. The clamping spring 11 can thereby be guided and actuated on both sides.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

Spring-force terminal connection 100
Conductor terminal 200
Bus bar 10
Clamping spring 11
Actuation lever 12
Clamping cage 13
First end section 14
Second end section 15
Projection 16
First wall 17
Second wall 18
Support leg 19
Retaining leg 20
Opening 21
Pivot axis 22
Recess 23
Actuation surface 24
Grip area 25
Actuating region 26
Actuating cam 27
Indentation 28
Indentation 20
Housing 30
Conductor insertion opening 31
Transverse side 32
Clearance 33
Latching region 34
Recess 35
Conductor L

The invention claimed is:

1. A spring-force terminal connection for connecting a conductor, comprising:

a bus bar;

a clamping spring by which the conductor to be connected is clamped against the bus bar when in a clamped state;

a pivotably arranged actuation lever, the clamping spring being actuatable by a pivoting movement of the actuation lever; and a clamping cage, which forms a space configured to accommodate the conductor to be connected, wherein the clamping spring comprises a leaf spring having only a single leg, the clamping spring comprising a first end section forming a clamping region and a second end section opposite the first end section and forming a holding region, and wherein the clamping spring is fastened to the clamping cage by the second end section.

2. The spring-force terminal connection according to claim 1, wherein, to fasten the clamping spring to the clamping cage, an opening is formed, in which the clamping spring is hooked with its second end section.

3. The spring-force terminal connection according to claim 1, wherein on the bus bar a projection is formed at which the clamping spring is held pretensioned with its first end section in an unclamped state.

4. The spring-force terminal connection according to claim 1, wherein the actuation lever is pivotably mounted on the clamping cage.

5. The spring-force terminal connection according to claim 1, wherein an actuation surface, which is integrally formed on the first end section and is configured to interact with the actuation lever to actuate the clamping spring, is formed on the first end section of the clamping spring.

6. The spring-force terminal connection according to claim 5, wherein a guide contour comprising an opening is formed on the clamping cage, through which opening the actuation surface of the clamping spring protrudes, so that the actuation surface of the clamping spring interacts with the actuation lever outside the clamping cage.

7. The spring-force terminal connection according to claim 1, wherein the clamping cage comprises a metal.

8. The spring-force terminal connection according to claim 1, wherein the actuation lever has an actuating cam configured to actuate the clamping spring.

9. A conductor terminal, comprising:

a housing, in which the spring-force terminal connection of claim 1 is arranged.

10. The conductor terminal according to claim 9, wherein the housing has a latching region on which the actuation lever is latchable.

* * * * *